United States Patent [19]

Grubman

[11] Patent Number: 4,749,113

[45] Date of Patent: Jun. 7, 1988

[54] ANTI-THEFT MONEY-CARRYING ARTICLE

[76] Inventor: Moe M. Grubman, 99-32-66 Rd., Rego Park, N.Y. 11374

[21] Appl. No.: 935,777

[22] Filed: Nov. 28, 1986

[51] Int. Cl.[4] ..... A44B 21/00; A45C 1/04

[52] U.S. Cl. ..... 224/229; 224/252; 224/191; 2/300

[58] Field of Search ..... 2/300, 311; 150/132, 150/133, 134, 143; 224/252, 253, 163, 191, 202, 209, 229, 236, 240, 241, 259

[56] References Cited

U.S. PATENT DOCUMENTS

| | | | |
|---|---|---|---|
| 120,584 | 11/1871 | Harris | 2/300 |
| 394,721 | 12/1888 | Pell et al. | 2/300 |
| 594,907 | 8/1906 | Schad | 224/206 |
| 815,277 | 3/1906 | Facette | 224/202 |
| 984,768 | 2/1911 | LeClaire | 224/236 |
| 1,209,401 | 12/1916 | Crouse | 2/300 |
| 1,313,229 | 8/1919 | Peterson | 2/300 |
| 1,414,199 | 4/1922 | Monaco | 2/300 |
| 1,506,255 | 8/1924 | Rosenstein | 2/300 |
| 1,679,606 | 8/1928 | Graves | 224/252 |
| 2,421,055 | 5/1947 | Cowan | 224/191 X |
| 2,474,495 | 6/1949 | Pollak | 224/253 X |
| 2,983,412 | 5/1961 | Ferguson | 224/253 X |
| 3,739,961 | 6/1973 | Soukeras | 224/209 |
| 3,982,675 | 9/1976 | Claypool | 224/252 |
| 4,060,876 | 12/1977 | De Soto | 224/252 X |
| 4,194,655 | 3/1980 | Tillotson | 224/191 |
| 4,416,315 | 11/1983 | Foley | 224/252 X |

FOREIGN PATENT DOCUMENTS

| | | | |
|---|---|---|---|
| 2419043 | 11/1979 | France | 224/252 |
| 8249 | of 1889 | United Kingdom | 224/191 |
| 878563 | 10/1961 | United Kingdom | 224/191 |
| 1587124 | 4/1981 | United Kingdom | 224/253 |

*Primary Examiner*—Henry J. Recla
*Assistant Examiner*—Ernest G. Cusick
*Attorney, Agent, or Firm*—William T. Hough

[57] ABSTRACT

A clip having a flat money-container suspended therefrom is clipable onto an upper edge of upright trousers, such that the money container is suspended inside the trousers below the upper edge thereof, and affixed to the clip is ornamental material shielding the clip from exterior discernment, and an additional securing strip affixed to the clip and the money-container with another clip affixed to the free distal end of the strip adapted to be clipped onto clothing, all as a combination, and there being two such combinations with the strips thereof crossing and threaded through a buckle, in the nature of a belt or a cummerbund or as suspenders.

6 Claims, 4 Drawing Sheets

FIG. 1
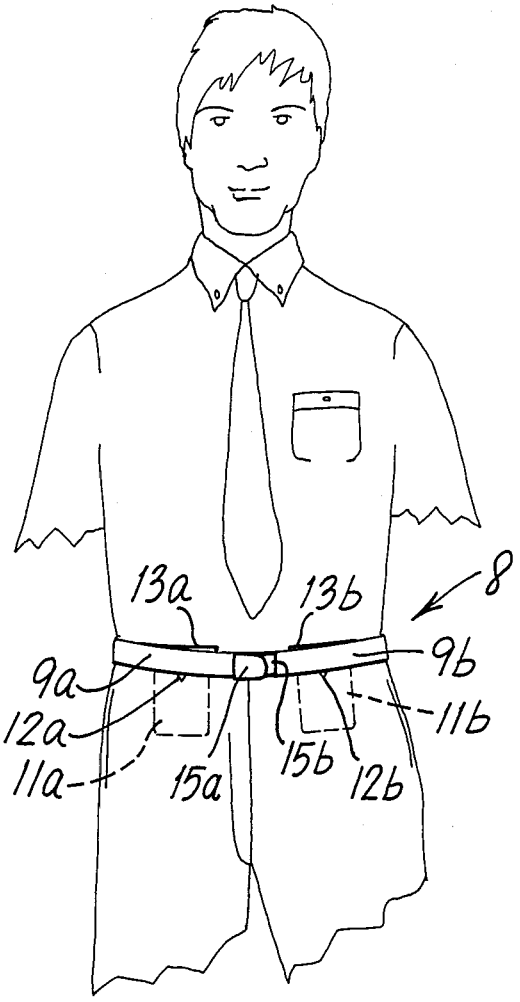
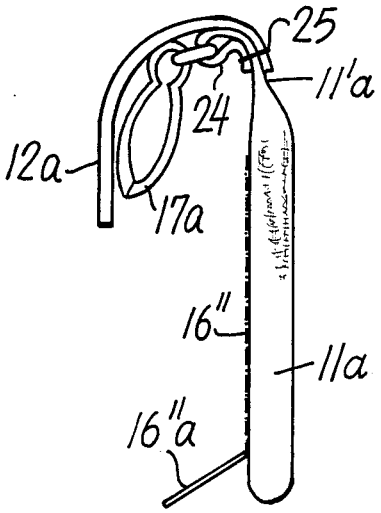
FIG. 8A
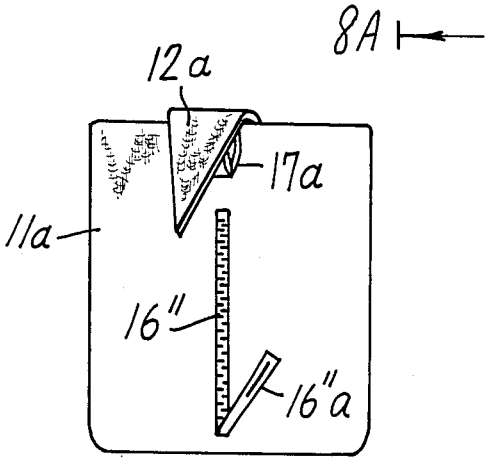
FIG. 8 8A

ANTI-THEFT MONEY-CARRYING ARTICLE

This invention is directed to an anti-theft money-carrying article to be worn on the clothed person, attached to his clothing in a hidden position.

FIELD OF INVENTION

Prior to the present invention, there have existed numerous articles in the nature of money belt or other articles for hiding money carried on the clothed person, to reduce the likelihood of theft of the money by robbers, pickpockets, burglarers, and the like.

BACKGROUND OF THE INVENTION

Typical such articles include suspenders that include pockets or containers a part thereof, as shown in U.S. Pat. No. 120,584 granted Nov. 7, 1971 to Harris, and U.S. Pat. No. 394,721 granted Dec. 18, 1888 to Know, and U.S. Pat. No. 894,907 granted Aug. 4, 1908 to Schad. A womans's garter-combination inclusive of a money pocket was granted U.S. Pat. No. 1,313,229 granted Aug. 12, 1919, to Peterson. Likewise, prior art includes exteriorly visible suspenders-containers which have holes at the bottoms of each of the containers, for buttoning onto the pants in the front, such containers thus being above the upper edge of the trousers when worn, as shown in U.S. Pat. No. 1,414,199 granted Apr. 25, 1922 to Monaco. Another suspender combination includes a money purse "detachably" attached by a exteriorly visible (when worn) belt-strap as fastened by an also exteriorly-visible buckle, to an exteriorly-visible end of suspenders that is attached to trouser buttons by long suspender-fastening cord and loops thereof, as shown in U.S. Pat. No. 815,277 Mar. 13, 1906 to Facette. The Knox and Schad patents relate to pencil-holding devices, exteriorly visible. The Harris patent has a concealed narrow compartment or pocket on a reverse side of the exterior strap of suspenders.

There has been an absence of a article that hides money-container while concurrently securing soundly the same to existing clothing, and while making the article appear to be merely an additional article of clothing or a part thereof, in order to prevent the would-be thief or robber from becoming readily aware of the existence of such money-container.

It should be noted that pickpockets and/or theives and/or robbers are usually in a hurry, frantic that the theft-act(s) will take too long during which time they might be discovered and/or caught.

SUMMARY OF THE INVENTION

Objects of the invention include the providing of a novel article avoiding or overcoming of problems and/or difficulties and/or short-comings of prior art with regard to anti-theft money containers for carrying money on the person of the dressed person.

More particularly, an object of this invention is to provide a novel anti-theft article including a container for carrying money, in which the article appears to be merely conventional worn clothing but of which a money-container or pocket book or the like is within clothing such as trousers or a skirt, below the upper edge thereof, hidden from exterior discernible view, i.e. secret.

Another particular object of the invention is to provide a novel anti-theft article in the nature of a strap or belt visibly and/or ornamentally worn around the waist of a person, giving the appearance of normal beltwear and/or ornamental dress-wear, but including a container for carrying money within and below an upper outer edge of worn clothing such as trouser, or a skirt, such that the container is hidden from exterior discernible view, even a sleep-wear.

Another object is to provide a novel article such as noted in preceding objects, in which the money-container is secured by sturdy attachment structure to the attaching device(s) and/or clothing article of which it is a part of the combination, to make it difficult or impossible for the money-container to be accidentally or intentionally torn-away from the other portions of the combination, one size being adjustable to fit any person.

Another object is to provide a money-carrying article which is a part of and/or hidden by normally worn clothing and which is attached thereto in a manner that will avoid detection and/or prolong or prevent the severing of the money-container from the person or his clothing, or from taking money from the container in too short a period of time.

Another object includes a method of making preferred article(s) of the type referred to above in preceding objects.

Another object is to have a moisture-proof pocket.

Other objects become apparent from the preceding and following disclosure.

One or more preceding objects are obtained by the invention as disclosed herein.

Broadly the invention may be described as an anti-theft money-carrying article-combination that includes at-least a flat container having an opening that is of a size and shape receivable of matter to be inserted into interior space of the container, and an vise-like clip on attaching structure (first attaching structure) such as a toothed-clip and mechanism thereof adapted for attaching to an upper upright edge of a clothing article such as man's trousers and/or a ladies's skirt.

In a preferred embodiment, there is included as a part of the combination, a strip of ornamental material attached to or extending from at-least one of the container and/or the attaching structure, positioned such that the attaching structure is critically concealed from exterior view sufficiently to avoid or deter exterior visible discernment of the attaching structure when it is attached to an upper edge of trouser's, for example, with the money-container hanging-downwardly within the trousers.

In a further preferred embodiment, there is included at-least one elongated strip in the nature of a belt, cummerbund, strap or the like adapted for partially or totally circumscribing a person's waist and adapted to be fastended and/or tied typically in the front, preferably including at its distal end (i.e., a distal portion) another attaching structure (a second attaching structure) for the further-fastening thereof to the same or other clothing.

In another preferred embodiment, there is additionally included a second combination such as described above—except that the second combination may or may not include a second money-container; the second combination is fastended to the first combination by virtue of overlapping and/or intermediately attached elongated strips above-described (i.e. an elongated strip overlapped and joined with another portion of another one of the elongated strip). Accordingly, the additional attaching structures, one found on each strip, are fastenable to one-another after wrapping the strips around the waist of the person on top of and covering (concealing beneath them) the first attaching structures (such as clips) and/or ornamental materials thereof. In such embodiment, there is preferably a separate money-container mounted as a part of each combination, in the manner previously described for the first combinatin.

In a further preferred embodiment, the intermediate connection between the first and second strips of the combined two combinations, is positioned such that the combination of first and second strips are utilizable as suspenders. Preferably the connection between the two strips is a buckle-like device, such as a guide-structure through-which the separate strips are threadable and crossed typically, making the entire combination utilizable more conveniently utilizable as a belt or a cummerbund or as a pair (unit) of suspenders for holding-up the trousers and/or skirt, or at-least appearing to do so.

In a preferred embodiment of the invention, a novel and critical method of making is utilized by which the entire article is sturdy against accidental and/or intentional separating the money-container from the attaching structure(s) and/or the strips by which the money-container is attached to and/or anchored to the worn clothing of the person, such as his trouser's upper edge or such as her skirt's upper edge. The critical method additionally provides a commercially neat and saleable item, including the ornamental portion as properly secured as a part of the neat combination. That method includes the following steps of making.

Firstly there is prepared an elongated stip of material having an ornamental front or exterior face and having an opposite reverse or interior face, being slightly wider at one distal end thereof. Secondly, the material is thereafter folded-over upon itself at the distal end sufficiently to reduce width of the wider distal end to be not significantly greater than or to be the same or smaller than about typical width of the elongated strip at other points therealong and sufficiently to form a neat and reinforced distal end, and stitching at-least on portion of that distal end sufficiently to form and secure the folded-over portion. An attaching means such a clip or the like is secured to the same distal end referred-to above, such that it may be attached or anchored to an upper edge of a pair of trousers or of a skirt, for example. A flat flexible container is attached (secured) to the same distal end and directly or indirectly thereby to the attaching means (or portion thereof), such as by stitching, bradding or the like. Preferably there is directly or indirectly secured to the same distal end and to the attaching means a reinforcing material of strength sufficient as to add durability bulk such that tearing and/or cutting-away of the container therefrom is made increasingly difficult to do either accidentally or intentionally. Thereafter, the elongated strip is folded along an elongated axis thereof along a fold-line located intermediate between opposite edges of the strip, preferably also folding at the same time the attached container along the same fold line, i.e. along a second axis extending in a direction substantially the same as the elongated axis, preferably coaxially.

BRIEF DESCRIPTION OF THE DRAWING

FIG. 1 illustrates a front view of a preferred embodiment of the an article of this invention, as worn by a person, being the double-combination embodiment of which elongated strips are fastened by snapped-together clips in the front location, with the body-circumscribing strips being secured firmly over and hiding or concealing therebeneath the trouser-clips and ornamental portions thereof. To each clip and/or ornamental material and/or strip are attached money-containers downwardly-suspended (shown in phantom) within the pants (trousers) of the illustrated person. The same embodiment of the article is shown in greater detail in each of FIGS. 2 and 3.

FIG. 6A illustrates an elevation plan part-view of an alongated strip, the unshown portion of the strip being typically identical to the narrow disclosed portion, typically being bluntly terminated at the unshown other distal end thereof. The illustrated terminal end thereof has widened dimensions.

FIG. 6B illustrates the embodiment of FIG. 6A in the same type view, but after having folded-over and sewn portions thereof.

FIG. 6C illustrates the embodiment of FIG. 6B in the same type view, but after having additionally sewn thereto the attaching-clip previously described.

FIG. 6D illustrates the embodiment of FIG. 6C in the same type view, but after additionally having added and sewn thereto each of a reinforcing strip of material and the flat flexible container having its zippered-opening.

FIG. 6E illustrates the embodiment of FIG. 6D in the same type view, but additionally having folded-over the strip and the container, and having secured the strip and attached end of the container by stitching to be secured in the folded state.

FIG. 6F illustrates the embodiment of FIG. 6E in the same type view, but additionally showing the article as it is being inverted (turned right-side-out) in order to expose the ornamental exterior face of the strip and in order to conceal various stitching afore-mentioned on the interrior face.

FIG. 8 illustrates another embodiment of the invention in front perspective view, having the attaching structure and its concealing ornamental material, and the money-container suspended downwardly therefrom.

FIG. 8A illustrates an elevation plan view taken along line 8A—8A of FIG. 8.

DESCRIPTION OF THE PREFERRED EMBODIMENTS

In so far as indicia are once described for the same or same-type indicia and/or for a common embodiment, or common element(s) of different embodment(s), description will not be redundantly repeated except perhaps to add clarity.

FIG. 1 illustrates a typical person (man) wearing a belt or cummerbund type article 8 of this invention having two combinations of separate strip-combinations joined-together, illustrating strip-portions 9*a* and 9*b*, respectively, having mounted on the ends thereof clips 15*a* and 15*b* respectively, which clips 15*a* and 15*b* are clipped (latched) to one-another. Also partially shown are the belt portion ends 13*a* and 13*b* respectively, each clipped to different upper edges of trousers of the person, and the downwardly pointed ends of the ornamental materials 12*a* and 12*b*. Shown in phantom, to merely portray the locations thereof inside the trousers, are the money-containers 11*a* and 11*b*.

FIG. 2 while again illustrating the above-noted elements, additionally shows and illustrates the belt-portions ends identified as 13*a* and 13*b* here shown in greater detail and completeness, as are also the clips 15*a* and 15*b*, and postively illustrating the money-containers 11*a* and 11*b* and zippers 16*a* and 16*b* and zipper-locks (and handles) 16'*a* and 16'*b* thereof, as well as illustrating a buckle-type strip-threader and guide device guide (structure) 14 through which are channeled and guided the two separate strips. Also, as shown behind the partially cut-away ornamental material 12*a*, there are present behind each of ornamental material 12*a* and 12*b* identical clips 17*a* (only one of which is shown) for fastening onto top edges of a man's trouser's or a ladies's skirt.

Figure 2:
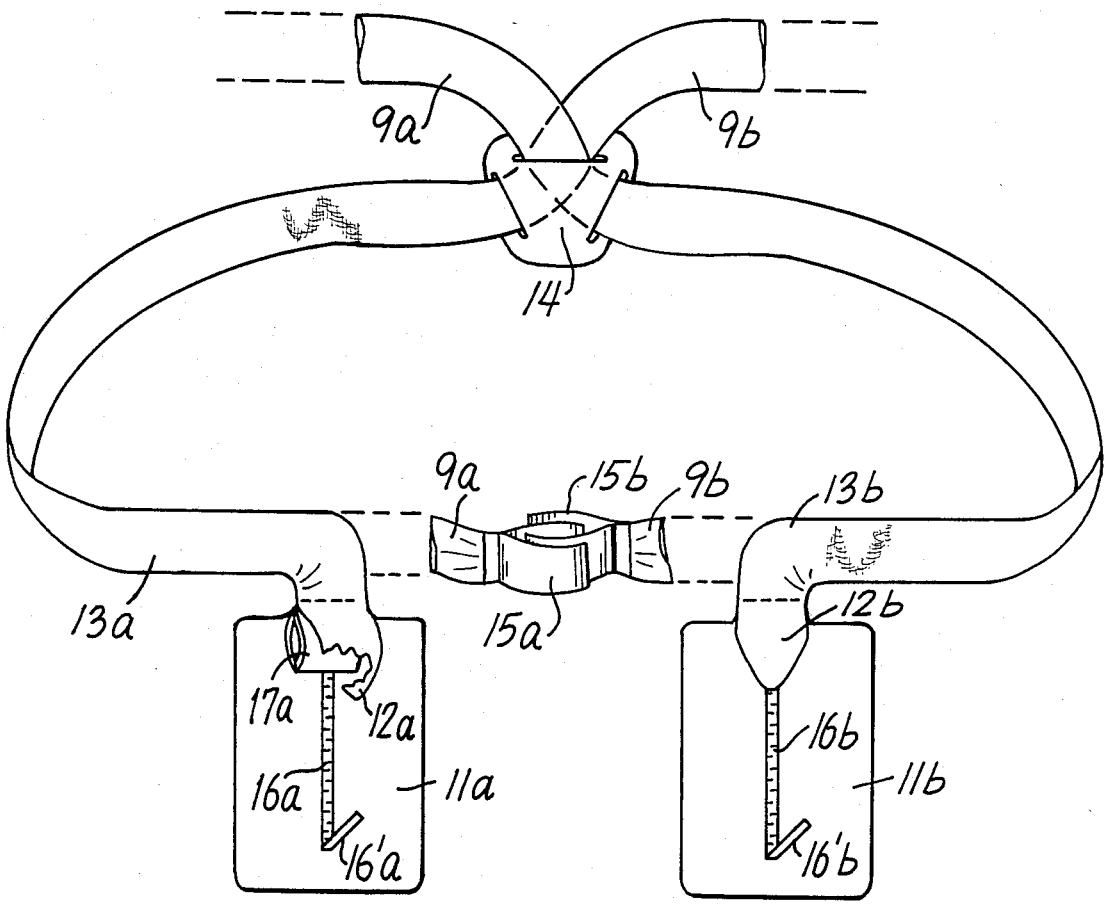
FIG. 2 illustrates in partial cut-away view, the embodiment described for FIG. 1, here shown in front perspective view.
Figure 3:
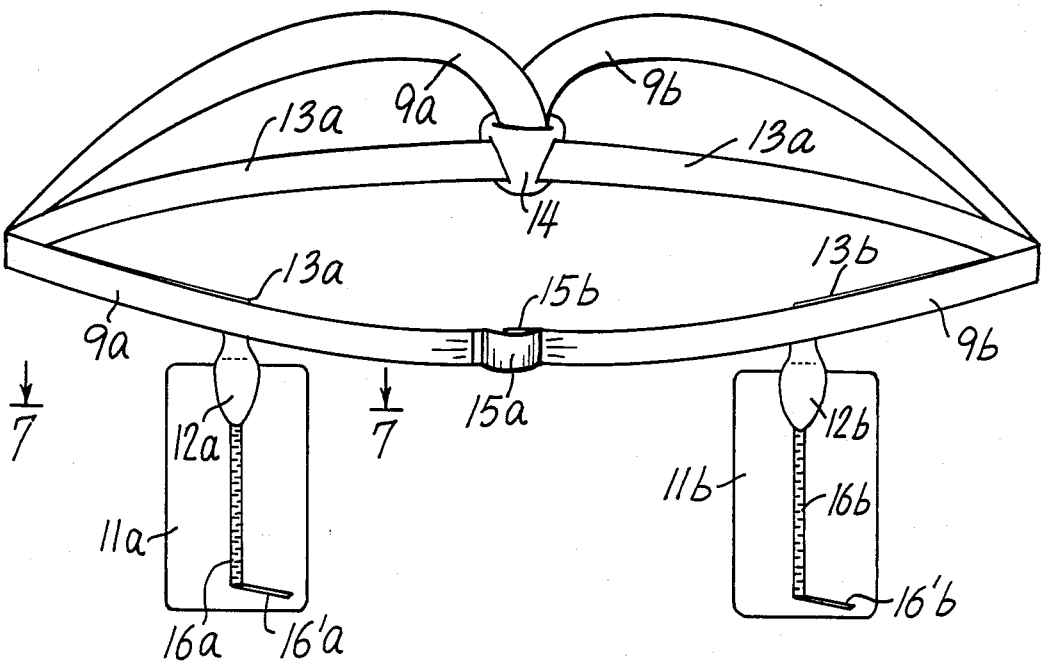
FIG. 3 illustrates again illustrates in front perspective non-cutaway view, the same embodiment described for each of FIGS. 1 and 2, also shown in front perspective view, as in FIG. 1 illustrating how the distal end portions of the elongated strips of the different combinations overlap and secure and conceal beneath them, the ends of the strips to which the money-containers and clips associated therewith are attached, worn as a belt or cummerbund.

FIG. 3 illustrates substantially the same elements as the FIG. 2 embodiment, but is devoid of cut-aways, thus illustrating in more normal appearance the positioning of the strip-portions 9*a* and 9*b* over and concealing the belt portions 13*a* and 13*b* therebeneath, respectively, typically in the same fashion shown in FIG. 1.

Figure 4:
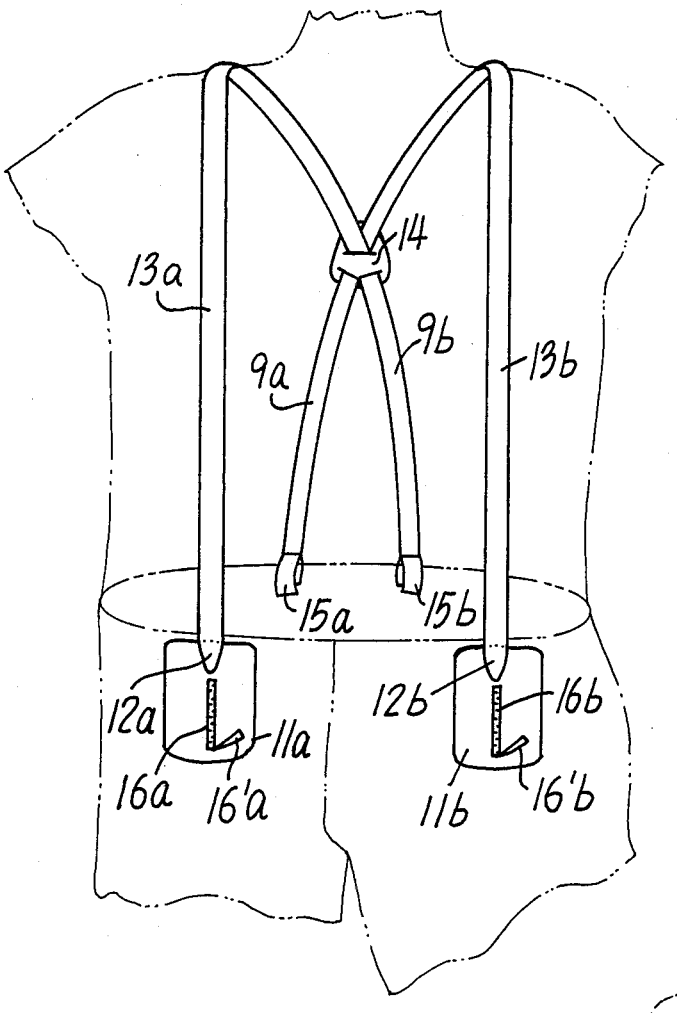
FIG. 4 illustrates in front perspective view the same embodiment as shown in FIG. 3, but illustrates how it would be mounted on a person (shown in phantom) wearing the same as suspenders, rather than as a belt or cummerbund.

FIG. 4 illustrates the same embodiment as that of FIG. 3, except as utilized as suspenders, still having the top-edge clips (not shown) beneath the ornamental material 12*a* and 12*b*, and showing in phantom the body of a person wearing clothing and in phatom showing the position of the front top edge of trousers aligned with the front clips (adjacent to the money-containers) and the back top edge of trousers aligned with the back clips, as well as illustrating the buckle strips-threader and guide structure 14.

Figure 5:
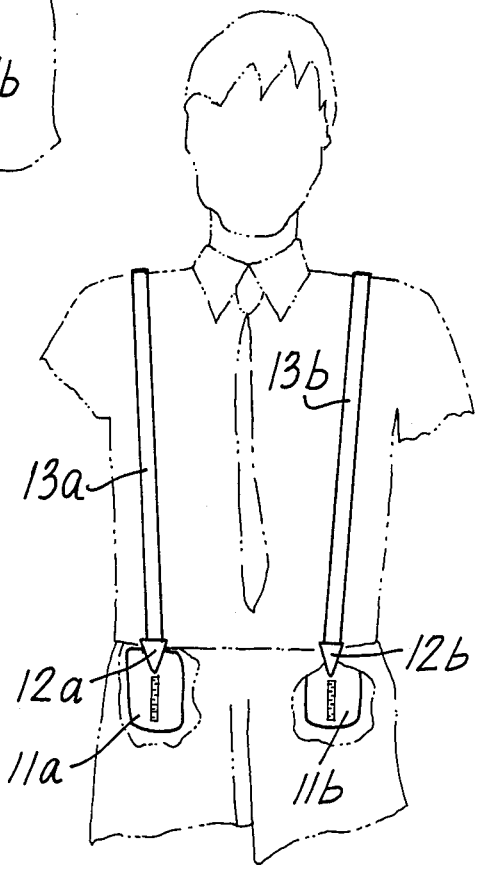
FIG. 5 illustrates in front perspective view the same embodiment and embodiment as that of FIG. 4, except illustrating its appearance, with partial cut-away, as mounted or worn by a person as or to appear to be used as suspenders.

FIG. 5 illustrate the same embodiment and use as that of FIG. 4, except typically showing its appearance as worn on a person, and with cut-away in the trousers, illustrating the fact that the money-containers 11*a* and 11*b* are suspended inside the trousers in a location not externally visibly discernible.

Figure 6A:
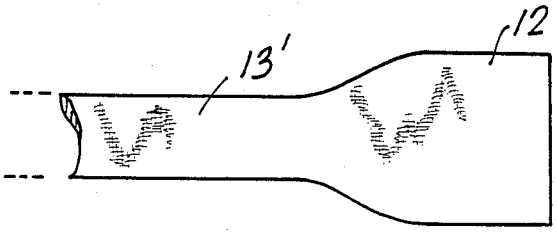
FIGS. 6A through 6F illustrate in front elevation plan view, the material during progressive sequential steps of a preferred method of making a preferred embodiment of the present invention.
Figure 6B:
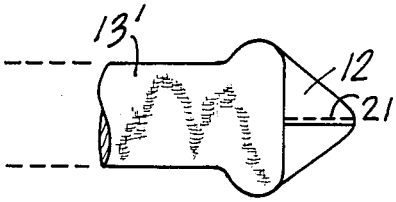
Figure 6C:
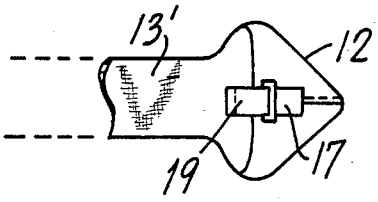
Figure 6D:
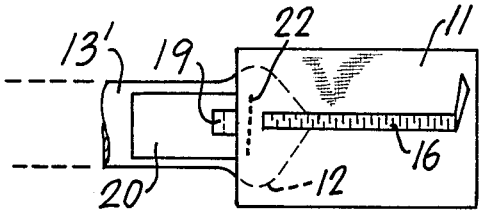
Figure 6E:
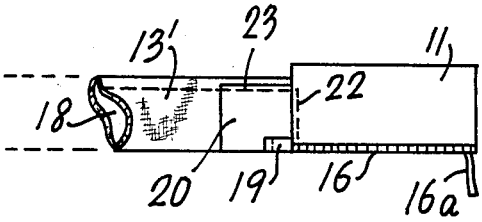
Figure 6F:
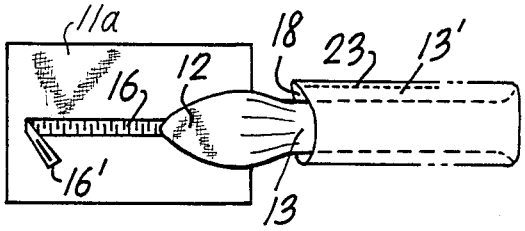

FIG. 6A illustrates a flexible fabric material 13' of which the illustrated face thereof is the interior or rear (typically non-ornamental) face thereof, having widened terminal or distal end portion 12 thereof. In FIG. 6B, the end, corner portions of portion 12 have been folded-over as shown and stitched together by stitches 21. FIG. 6C illustrates the fabric-end portion 19 of the attaching combination, i.e. the tab, sewed to the sewn portion described in FIG. 6B, the tab-portion 19 supporting the clip 17. FIG. 6D illustrates the additionally sewn-on reinforcing material 20 and money-container 11, sewn by stitches 22, and shows the zipper 16. FIG. 6E shows the folded state of the materials of FIG. 6D, folded and sewn by stitches 23, forming a hollow through-passage 18. FIG. 6F illustrate an intermediate stage of inverting the structure of FIG. 6D, showing the pulling-through of the container 16 and distal end portion 12 (showing its exterior ornamental face as here that portion is inverted), which when fully inverted will have the appearance of one of the combinations (strip, clip, and container at the distal end, of FIG. 2.

Figure 7:
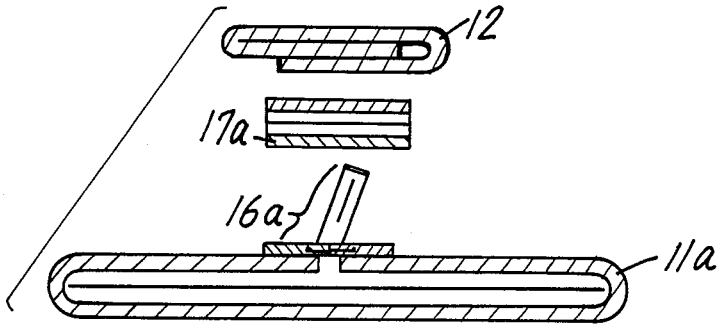
FIG. 7 illustrates a cross-sectional view as taken typically along line 7—7 of FIG. 3.

FIG. 7 illustrates in cross-section, the ornamental material 12, the clip (or snap-on clamp) 16*a*, and the money-container 11*a*.

FIG. 8 illustrates another embodiment of some of the same elements previously described, being devoid of any strip attached thereto.

FIG. 8A, as taken along line 8A—8A of FIG. 8, illustrates a side appearance of the embodiment of FIG. 8A, but also is the same appearance of prior other embodiments of those elements.

The various clips 15*a*, 15*b*, 17*a*, 17*b*, and 17 may be any conventional or desired type of clip or snap-on article or device adapted to detachably snap onto an edge of fabric or other material. The connection between the clip itself and the downwardly suspended money-container may be either rigid or flexible, provided that the arrangement permits or provides for the money-container to be downwardly suspended such that the downwardly suspended money-container and any connection to the snap are not visibly discernible to be supporting nor a part of a money-container or the like. Clip 17*a* is shown in FIG. 8A as mounted in fabric 24 having loop-securing fastener 25. The strip material of strip portions 9*a*, 9*b*, 13*a* and 13*b* may be of any desired or suitable material such as fabric and/or leather and/or plastic, or the like provided it is substantially flexible and has reasonable sturdiness and strength as to withstand stretching strains and reasonable wear and tear; however, it preferably has at-least an ornamental exterior face of any desired color and/or design, and in order that its terminal end portions 12*a* and 12*b* and 12 may have ornamental appearance in its concealing function covering the clips 17*a* and 17*b* (clip 17*b* not shown but being identical to that shown for 17*a*, but other shapes and/or designs being optional as previously described for clips and/or snap-on devices or structures. Money containers 11, 11*a* and 11*b* may be likewise of any desired material, fabric, plastic, leather or blend(s) thereof, or the like, provided such has reasonable sufficient strength and durability as to resist accidental or intentional tearing or ripping-away thereof. The zipper 16, 16*a* and 16*b* may be of any conventional or desired zipper material typically such as metal and/or plastic, and likewise for the zipper lock(s) 16' and 16'*a* amd 16'*b*. The buckle strip-guide 14 may be of fabric, metal, leather, plastic, or any other conventional or desired material of sufficient toughness for the structure to avoid tearing or breaking under reasonable stress and strain while performing its function.

It is within the scope of the invention to make such variations and substitution of equivalents and variations within ordinary skill of the art.

I claim:

1. An anti-theft money-carrying article for attaching to an uprightly-worn edge of at least one article of clothing when worn, while concurrently holding-up the article of clothing when worn, comprising in combination: a flat container having an opening of a size and shape adapted to receive insertable matter into and through said opening; first vise-like clip-on attaching means for detachably attaching to the upper upright edge of the article of clothing, and for suspending downwardly the container from a point of attachment of the vise-like clip-on attaching means attached to said upper upright edge, in a concealed state within the clothing when the clothing is worn, and at least one ornamental material attached to said first vise-like clip-on attaching means and said container, positioned to conceal said first clip-on attaching means from visible discernment from a location exterior to the clothing when the first clip-on attachning means is clipped onto said edge of said article of clothing and when said container is downwardly suspended within said clothing, and a plurality of elongated strips, at least one of said plurality of elongated strips being attached to and extending from said at least one ornamental material, said container and said first vise-like clip-on attaching means, with the at least one elongated strip being adapted to extend a predetermined distance as a distal portion sufficiently to at least partially circumscribe a person's body wearing the article of clothing; said at least one elongated strip having said distal portion, and second attaching means mounted on said distal portion of said elongated strip, for attaching at least one of said article of clothing when worn, and to a different one of said plurality of elongated strips such that said container is additionally secured against theft.

2. An anti-theft money-carrying article of claim 1, including a plurality of said strips and said second attaching means, said plurality of strips being fastened together at points intermediate of their lengths, such that said plurality of strips fasten the flat container to the article of clothing.

3. An anti-theft money-carrying article of claim 2, including a plurality of said containers and including predetermined points of attachment on said plurality of containers, a different one of the first and second attaching means being attached each to a different one of said plurality of containers.

4. An anti-theft money-carrying article of claim 3, inwhich said plurality of strips are positioned at said predetermined points of their attachment, such that said plurality of strips are wearable as suspenders for said article of clothing when worn.

5. An anti-theft money-carrying article of claim 4, including a guide means for threading said plurality of strips through and for positioning said plurality of strips in positions predetermined for providing for wearing as suspenders for said article of clothing when worn.

6. An anti-theft money-carrying article of claim 1, in which said elongated strip is shaped and adapted to function as a belt.

* * * * *